US008689692B2

(12) United States Patent
Brill et al.

(10) Patent No.: US 8,689,692 B2
(45) Date of Patent: Apr. 8, 2014

(54) GUIDED WEAPON WITH IN-FLIGHT-SWITCHABLE MULTIPLE FUZE MODES

(75) Inventors: Yariv Brill, Haifa (IL); Ohad Hanan Nuriel, Hadera (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 545 days.

(21) Appl. No.: 12/918,327

(22) PCT Filed: Feb. 12, 2009

(86) PCT No.: PCT/IB2009/050571

§ 371 (c)(1), (2), (4) Date: Nov. 10, 2010

(87) PCT Pub. No.: WO2009/104112

PCT Pub. Date: Aug. 27, 2009

(65) Prior Publication Data

US 2011/0041720 A1 Feb. 24, 2011

(30) Foreign Application Priority Data

Feb. 21, 2008 (IL) ..... 189692

(51) Int. Cl.
*F42C 9/14* (2006.01)

(52) U.S. Cl.
USPC ..... 102/265; 102/266; 102/270; 102/271; 102/473; 102/501

(58) Field of Classification Search
USPC ..... 102/265, 266, 270
See application file for complete search history.

(56) References Cited

U.S. PATENT DOCUMENTS

| | | | |
|---|---|---|---|
| 3,722,416 | A | 3/1973 | Lunt et al. |
| 3,839,963 | A | 10/1974 | Nathan et al. |
| 5,147,973 | A | 9/1992 | Ziemba |
| 5,255,608 | A | 10/1993 | Min et al. |
| 7,213,518 | B2 | 5/2007 | Sutcliffe |
| 2006/0232761 | A1 | 10/2006 | McConville et al. |

FOREIGN PATENT DOCUMENTS

| | | |
|---|---|---|
| EP | 1162428 | 12/2001 |
| EP | 1674819 | 6/2006 |

*Primary Examiner* — J. Woodrow Eldred
(74) *Attorney, Agent, or Firm* — Mark M. Friedman

(57) ABSTRACT

A method for operating a guided munition with a switchable fuze arrangement includes launching the guided munition towards a target. During flight of the guided munition, images are provided to a remote operator, who supplies a switching input. Responsive to said switching input, the fuze arrangement is switched to either of at least two of the following states: a delayed detonation state in which detonation of the explosive charge is delayed by a time delay after impact of the guided munition, an impact detonation state in which detonation of the explosive charge occurs on impact of the guided munition, a proximity detonation state in which detonation of the explosive charge is triggered by a proximity sensing arrangement, and a disabled state in which the guided munition functions as a guided kinetic shell without detonation of the explosive charge.

26 Claims, 4 Drawing Sheets

40

GUIDED WEAPON WITH IN-FLIGHT-SWITCHABLE MULTIPLE FUZE MODES

RELATED APPLICATIONS

This patent application is a U.S. National Phase Application of PCT/IB2009/050571 filed on Feb. 12, 2009, which claims priority of Israeli Patent Application No. 189692 filed Feb. 21, 2008, the contents of which are incorporated herein by reference.

FIELD AND BACKGROUND OF THE INVENTION

The present invention relates to guided weapons and, in particular, it concerns guided weapons and corresponding methods of operating guided weapons in which the mode of operation of an explosive charge can be switched by a remote operator during flight.

It is known to provide munitions with various different types of fuze arrangement for detonating an explosive charge against a target under differing operational needs. Many munitions are provided with an impact-detonation fuze which detonates the explosive charge immediately on impact against a target. Where maximum effect is desired within a soft-walled structure (for example, after entering a building window or penetrating into a light vehicle), a munition with a delayed detonation fuze may be preferred so that the munition penetrates into the soft-walled structure prior to detonation. In cases where a direct hit on the target cannot be reliably achieved, or where detonation would be advantageous if it occurred at a stand-off distance prior to impact, a munition with a proximity fuze may be used.

In order to reduce the number of munitions which must be kept in stock, and to increase operational flexibility, it has been proposed to provide a munition with a fuze capable of operating in more than one mode of operation. An example of this may be found in U.S. Pat. No. 3,722,416 which describes a switchable fuze arrangement which allows a pilot to change the mode of operation of the fuze between "proximity", "impact" and "delay" by supplying a corresponding electrical switching signal prior to launch of the missile or bomb. Once launched, the mode of operation is fixed.

Many modern guided munitions provide a remote operator with real-time images generated by an image sensor carried by the munition, allowing the remote operator to navigate the munition towards the intended target. Two-way communication for transferring the images to the remote operator and operator inputs to the munition is provided either via a wireless communication system or via a trailing connection such as an optical fiber. In such cases, the remote operator is continuously updated with an image of the target region, and may become aware of situations which would have favored a different type of fuze operation than was selected prior to launch. This is particularly true in cases of BLOS (beyond line-of-sight) and LOAL (lock-on after launch) operation where the target is not visible to the operator at the time of launch and target acquisition occurs during flight.

There is therefore a need for a guided weapon and corresponding method of operating guided a weapon in which the mode of operation of a fuze for detonating an explosive charge can be switched by a remote operator during flight.

SUMMARY OF THE INVENTION

The present invention is a switchable-mode guided munition and a corresponding method for operating a guided munition.

According to the teachings of the present invention there is provided, a method for operating a guided munition carrying an imaging sensor, an explosive charge and a switchable fuze arrangement against a target, the method comprising the steps of: (a) launching the guided munition towards the target; (b) during flight of the guided munition, providing images from the imaging sensor to a remote operator; (c) receiving from the remote operator a switching input; and (d) responsive to the switching input, switching the fuze arrangement to either of at least two states selected from the group consisting of: (i) a delayed detonation state in which detonation of the explosive charge is delayed by a time delay after impact of the guided munition, (ii) an impact detonation state in which detonation of the explosive charge occurs on impact of the guided munition, (iii) a proximity detonation state in which detonation of the explosive charge is triggered by a proximity sensing arrangement, and (iv) a disabled state in which the guided munition functions as a guided kinetic shell without detonation of the explosive charge.

There is also provided according to the teachings of the present invention, a switchable-mode guided munition comprising: (a) a munition body; (b) an imaging sensor associated with the munition body for generating images of a target; (c) an explosive charge housed within the munition body; (d) a fuze arrangement associated with the explosive charge; and (e) a communication system for transmitting the images to a remote operator and for receiving inputs from the remote operator, wherein the fuze arrangement is configured as an in-flight-switchable fuze arrangement responsive to a switching input received from the remote operator via the communication system to switch to either of at least two states selected from the group consisting of: (i) a delayed detonation state in which detonation of the explosive charge is delayed by a time delay after impact of the guided munition, (ii) an impact detonation state in which detonation of the explosive charge occurs on impact of the guided munition, (iii) a proximity detonation state in which detonation of the explosive charge is triggered by a proximity sensing arrangement, and (iv) a disabled state in which the guided munition functions as a guided kinetic shell without detonation of the explosive charge.

According to a further feature of the present invention, the fuze arrangement is switchable to any of at least three states selected from the group.

According to a further feature of the present invention, the fuze arrangement is switchable to any of the four states of the group.

According to a further feature of the present invention, the at least two states include the delayed detonation state.

According to a further feature of the present invention, the at least two states include the impact detonation state.

According to a further feature of the present invention, the at least two states include the proximity detonation state.

According to a further feature of the present invention, the proximity sensing arrangement is sensitive to proximity of an object located ahead of the guided munition.

According to a further feature of the present invention, the proximity sensing arrangement is sensitive to proximity of an object located laterally with respect to the guided munition.

According to a further feature of the present invention, the at least two states include the disabled state.

According to a further feature of the present invention, the fuze arrangement is additionally switchable to immediately detonate the explosive charge such that the guided munition self destructs.

According to a further feature of the present invention, the guided munition is a guided surface-to-surface missile.

According to a further feature of the present invention, the guided munition is a guided air-to-surface missile.

According to a further feature of the present invention, the guided munition is a guided air-to-surface bomb.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a switchable-mode guided munition and a corresponding method for operating a guided munition.

The principles and operation of guided munitions according to the present invention may be better understood with reference to the drawings and the accompanying description.

Figure 1:
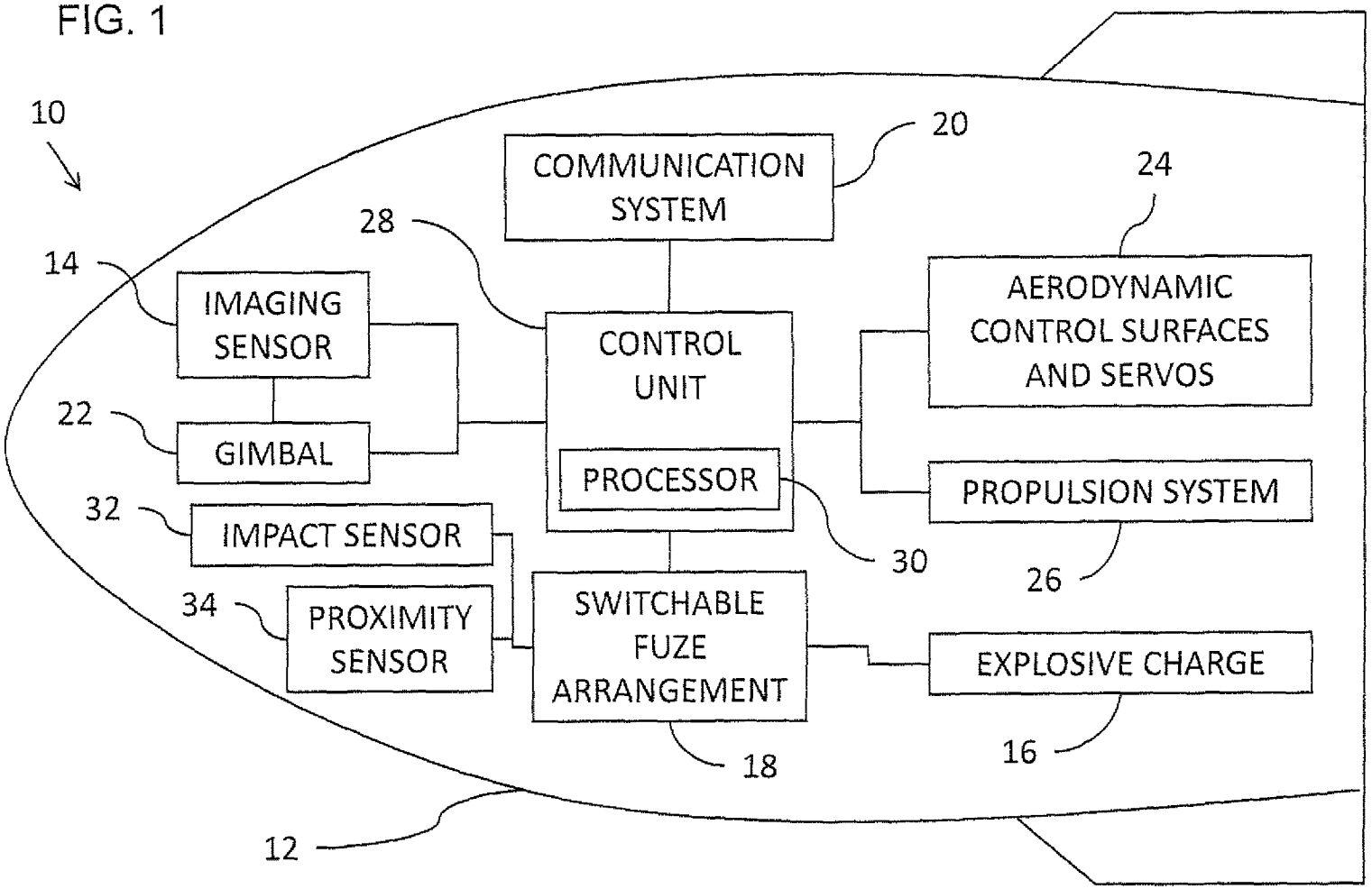
FIG. 1 is a schematic representation of a switchable-mode guided munition, constructed and operative according to the teachings of the present invention.

Referring now to the drawings, FIG. 1 shows schematically the main components of a switchable-mode guided munition, generally designated 10, constructed and operative according to the teachings of the present invention. Generally speaking, munition 10 includes a munition body 12 which carries: an imaging sensor 14 for generating images of a target; an explosive charge 16; a fuze arrangement 18 associated with explosive charge 16; and a communication system 20 for transmitting the images to a remote operator system (described below with reference to FIG. 2) and for receiving inputs from the remote operator system. Fuze arrangement 18 is configured as an in-flight-switchable fuze arrangement responsive to a switching input received from the remote operator system via the communication system to switch to either of at least two different states of operation. These states of operation include two or more of the following:

- a delayed detonation state in which detonation of the explosive charge is delayed by a time delay after impact of the guided munition,
- an impact detonation state in which detonation of the explosive charge occurs on impact of the guided munition,
- a proximity detonation state in which detonation of the explosive charge is triggered by a proximity sensing arrangement, and
- a disabled state in which the guided munition functions as a guided kinetic shell without detonation of the explosive charge.

In certain particularly preferred implementations, fuze arrangement 18 is configured to be switchable to any of at least three, or all four, of these states, and optionally switchable to one or more additional state. In certain cases, fuze arrangement 18 may be additionally switched to perform immediate on-demand detonation of explosive charge 16 such that the guided munition self destructs. All of these functions will be discussed further below.

It will be immediately apparent that the present invention as described provides profound advantages, allowing the operator of a video-guided munition to react to a real-time developing scenario as viewed through the imaging sensor of the munition by adapting the mode of operation of the munition during flight. This and other advantages of the present invention will be better understood in view of the following detailed description.

Before addressing the features of the present invention in more detail, it will be useful to define certain terminology as used herein in the description and claims. Firstly, the term "munition" is used herein to refer to any and all types of munition containing an explosive charge (a warhead) which fly, glide, fall or are fired through the air towards a target. Examples of munitions to which the present invention is applicable include, but are not limited to, surface-to-surface missiles, air-to-surface missiles, attack-UAVs and air-to-surface bombs, all for use against surface targets, whether land based or sea-based. The munition of the present invention may be of any size, spanning from small man-portable missiles to large aircraft-launched bombs.

The invention relates to munitions which carry an imaging sensor, and which have a communication system for relaying real-time images from the image sensor back to an operator. These features typically exist in the class of "video-guided munitions," where the munition is either steered by remote control towards a target or automatically homes towards a target with optional updating or overriding of the target tracking by an operator. It should be noted, however, that the present invention may also be applied to non-steerable rockets and shells so long as the imaging sensor and communication system are provided.

The "imaging sensor" of the present invention may be any type of imaging sensor which generates images which are useful when displayed, directly or after further processing, for an operator to make decisions regarding a viewed target. Typically, the imaging sensor is a focal plane array sensor sensitive to at least one band of wavelengths in the visible or infrared portions of the electromagnetic spectrum. Examples include, but are not limited to, monochrome or color sensors employing CCD or CMOS arrays, and FLIR sensors.

The communication system providing communication between the munition and the operator may be a wireless communication system, typically based on radio frequency or microwave signals, or may be a "wired" communication link, such as a trailing optic fiber. The download and display of images to an operator and the return communication of control inputs are described as "real-time" in the sense that any time lag between sampling of the images and display to the operator is short compared to the time of flight of the munition. Particularly for remotely steered munitions, any time lag must be kept to a small fraction of a second in order to avoid overcorrection, and the display is typically perceived by the user as effectively immediate.

The word "flight" and corresponding phrases "in-flight", "during flight" etc., are used to refer to the passage of the munition through the air, whether the motion is primarily a downward "falling", a roughly ballistic path, or stabilized flight. Similarly, the word "launch" refers to the process of putting the munition into flight, whether by firing from a launcher, from a gun, releasing from an aircraft or any other form of "launching" appropriate to the munition in question.

The term "fuze" is used to refer to the sum total of the components which are directly responsible for detonation of the main explosive charge. The fuze may be of any known type, including an arrangement of analogue electrical circuitry with appropriate components, a digital processor, or any combination thereof, and may also combine various mechanical components, as is known in the art. "Triggering" of the fuze refers to supply of an input to the fuze which sets off the detonation, which may occur instantly or may be delayed. Triggering is typically performed by a sensor, such as an impact sensor or a proximity sensor.

When the fuze is described as operating in a give mode, it should be noted that the mode is defined by the primary effect achieved under most operating circumstances, and does not necessarily mean that all other modes of operation are prevented. For example, if the fuze is switched from an impact-responsive mode to a proximity-responsive mode, the impact-responsive triggering is not necessarily disabled. Under most normal operating conditions, the proximity sensor will trigger the fuze before impact occurs, thereby rendering the enabling or disabling of the impact-responsive trigger unimportant. However, in certain circumstances, it may be considered preferable to leave the impact-responsive trigger enabled as a back-up mechanism in case the proximity sensor is for any reason ineffective.

The term "switching" or "switchable" is used to refer to the capability of the fuze to be actuated so as to operate in either of at least two states. Thus, for example, a fuze which can be switched from an unarmed state to either of two armed state modes is referred to as being switchable to either of the modes. It is not necessarily possible to switch the state of the fuze between different modes after it has already been set, although the capability to reset the state more than once during the flight of the munition may be highly advantageous.

Finally with regard to terminology, the term "ahead" is used to refer to a direction lying generally in front of the munition in its direction of travel while "lateral" is used to refer to objects located to the side of the munition, i.e., which the munition is currently passing.

Turning now to the features of the present invention in more detail, FIG. 1 shows schematically the structural features of munition 10. It should be noted that not all components illustrated are necessary in all implementations, and additional components may be added, all according to the design considerations for the given type of munition and its intended application.

Although the invention may in some cases be implemented with imaging sensor 14 in a fixed position relative to munition body 12, imaging sensor 14 is typically mounted on a gimbal 22 which allows a range of angular displacement of the optical axis of the imaging sensor. In the case of a scanning imaging sensor, gimbal 22 becomes an essential part of the image sampling process. Images acquired by imaging sensor 14 are typically preprocessed, for example, by data compression in order to reduce the required communication bandwidth, and are then transferred via communication system 20 to the remote operator for display.

As mentioned above, the present invention relates primarily, although not exclusively, to guided munitions which can control, or at least modify, their flight path during their flight. Control of the flight path is typically achieved by providing aerodynamic control surfaces 24 which are moved by suitable arrangements of servos, or other actuators. It is noted that other steering mechanisms, such as for example pyrotechnic deflectors (not shown), also fall within the scope of the invention. In the case of a propelled munition, such as a missile, munition 10 also includes a propulsion system 26.

The various components of munition 10 are shown as being controlled and interconnected by a control unit 28 which includes at least one processor 30. Control unit 28 may be implemented in various ways, as will be clear to one ordinarily skilled in the art, including as a general purpose processing system operating with suitable software, as a dedicated hardware device, and any combination thereof. Furthermore, the subdivision of hardware and functions between control unit 28 and the various other components of munition 10 is somewhat arbitrary since some or all of the functions of control unit 28 may be combined with the individual components. For example, imaging sensor 14 may include a processing subsystem for performing any necessary pre-processing of the output video signal, and communication system 20 may include suitable input buffering and any other required hardware to allow direct interconnection between imaging sensor 14 and communication system 20. The same is true of the interconnection between communication system 20 and aerodynamic control surfaces 24 and switchable fuze arrangement 18. All such variants fall within the scope of the present invention.

Explosive charge 16 may be any type of explosive charge suited to the intended application, and may be combined with suitable liners, fragments or other components to form any suitable type of warhead. Examples include, but are not limited to, a high explosive warhead, a fragmentation warhead, a shaped charge warhead, and an explosively formed projectile warhead. Furthermore, explosive charge 16 may be configured for ejecting or dispersing a separate lethal or non-lethal payload.

Associated with switchable fuze arrangement 18 are one or more sensors which provide trigger inputs according to the various modes of operation which are to be made available to the operator. In the case illustrated here, these include an impact sensor 32 and a proximity sensor 34. Both of these sensors may be implemented using standard components well know for these purposes. Impact sensor 32 may for example be an electro-mechanical arrangement which either completes or breaks an electrical circuit. Proximity sensor 34 may be implemented using any suitable technology, such as, a radar-type sensor which senses echo of emitted radio frequency radiation from nearby objects in at least one direction, or using one or more laser range finder or the like. Depending on the intended application, the proximity sensor may be configured to generate a trigger output in response to proximity either in response to "forward" proximity of an object located ahead of the guided munition, i.e., roughly along the direction of travel of the munition, or in response to "lateral" proximity of an object located laterally with respect to the guided munition, i.e., which the munition is passing. In certain cases, proximity sensor 34 may be configured to sense proximity over a wide range of angles, or a plurality of angular ranges, spanning both forward and lateral regions. Alternatively, more than one proximity sensor may be provided to offer switchable modes between forward and lateral proximity triggered modes.

Switchable fuze arrangement 18 is typically implemented using conventional fuze implementations with the changes required to provide the recited switchable functionality, as will be clear to one ordinarily skilled in the art. By way of one non-limiting example, the required switching functions may be implemented as shown in Table 1:

TABLE 1

| MODE | FUZE OPERATION |
|---|---|
| IMPACT | Charge detonator capacitors (if required); connect detonation circuit to impact sensor trigger circuit. |
| IMPACT - DELAY | Charge detonator capacitors (if required); connect delay circuit to impact sensor trigger circuit. OR actuate delay function in fuze processor to |

TABLE 1-continued

| MODE | FUZE OPERATION |
|---|---|
| | introduce delay between impact sensor trigger signal and detonation. |
| PROXIMITY | Charge detonator capacitors (if required); connect detonation circuit to proximity sensor trigger circuit. |
| NEUTRALIZE (KINETIC) | Discharge detonator capacitors through a resistor. |
| SELF-DESTRUCT | Charge detonator capacitors (if required); close detonation circuit with detonator capacitors for immediate detonation. |

Figure 2:
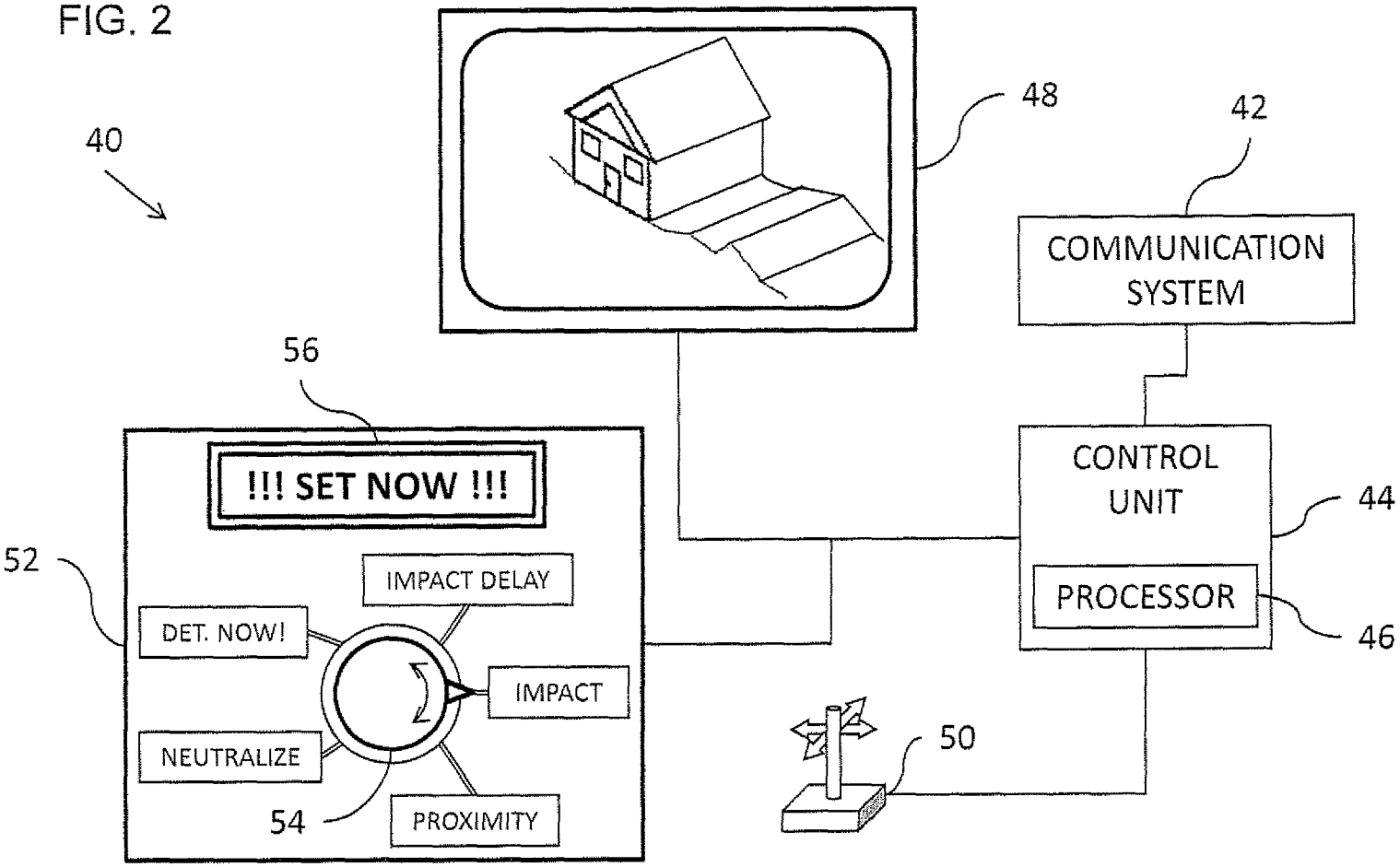
FIG. 2 is a schematic representation of a remote operator system for operating the switchable-mode guided munition of FIG. 1.

Turning now to FIG. 2, this shows schematically a remote operator system, generally designated 40, configured to allow an operator to operate munition 10 according to the teachings of the present invention. Generally speaking, remote operator system 40 includes standard elements employed to control a video-guided munition including: a communication system 42 for receiving video images from the munition and transmitting user control commands back to the munition; a control unit 44 including a processor 46; a display 48 for displaying the video images to the operator; and an input interface, represented by joystick 50, for inputting user commands or control inputs for transmission back to the munition. For the purpose of the present invention, input interface 50 is adapted or supplemented to allow selection of a fuze state, corresponding to a desired mode of operation, for transmission to the munition during its flight.

In the implementation illustrated here, an additional control panel 52 (not to scale) is provided to allow operator selection of the desired mode of operation. Control panel 52 has a mode selector 54, which may be implemented as a rotatable dial as shown, as a number of push buttons, a touch screen or any other suitable user input. In some cases, the mode selector 54 may be configured to generate a corresponding command to munition 10 each time the selection is changed. Alternatively, a confirmation input 56 may be provided as a separate input, here labeled "SET NOW", to confirm the selected mode and initiate generation of a command from control unit 44 via communication systems 42 and 20 to switchable fuze arrangement 18.

Parenthetically, it should be noted that the video images from the munition may be displayed on more than one display device, and that the functions of steering munition and of switching operation of the fuze may be performed by two separate operators located in the same place or remote from each other.

At this stage, the operation of munition 10 and the corresponding method of the present invention will be clear. Specifically, after launch of munition 10 towards a target, a remote operator monitors video images received from imaging sensor 14 during flight and assesses the location and situation of the target. Based on his assessment of the situation, the operator selects the desired mode of operation using mode selector 54 and confirms the mode selection via confirmation input 56. A corresponding command is then transmitted via communication systems 42 and 20 to switchable fuze arrangement 18, and causes corresponding switching of the fuze state, for example, as detailed above. Optionally, a confirmation signal may be transmitted back from munition 10 to remote operator system 40 which generates a visual or audio confirmation to the operator that the change in state has been successfully implemented.

The remaining FIGS. 3A-4B illustrate schematically various scenarios in which the switching of the fuze to a particular state provides particular advantages. It will be noted that each of the recited modes of operation has its own advantages in certain scenarios such that the ability to switch between any pair of two states is believed to provide a unique and non-trivial set of advantages, rendering each such combination patentable in its own right.

Figure 3A:
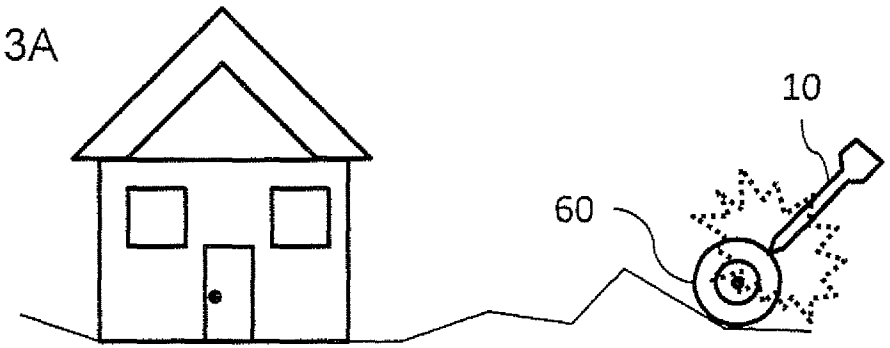
FIGS. 3A-3C are schematic representations of operation of the switchable-mode guided munition of FIG. 1 in three different modes of operation.

Referring now to FIG. 3A, this illustrates a case where a target 60 is located in an exposed position, making immediate impact detonation a suitable and effective choice.

Figure 3B:
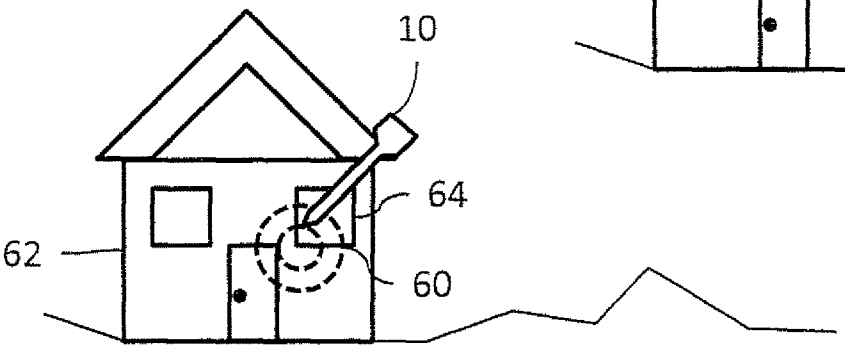

FIG. 3B illustrates a similar case in which target 60 is located within a building 62. This scenario is particularly helpful for illustrating the significance of the present invention as follows. At the time of launch, the target may not yet even be inside the building, making it impossible to foresee the situation which will arise during closing of the munition on the target. As the munition approaches the building, the remote operator identifies that the target is within the building and sees via the relayed real-time video images whether the building window is open or closed. If open, the immediate impact-detonation mode is appropriate. However, if the window is closed, on-impact detonation would result in detonation of the explosive charge outside the building, possibly rendering it ineffective against the target. Instead, the remote operator switches during flight to the impact-delay mode, in which triggering occurs on impact with the window, but detonation is delayed by a given time delay, typically no more than about half a second. This allows time for munition 10 to enter the building so that detonation occurs within the building.

Parenthetically, it should be noted that additional modes which may be provided according to the teachings of the present invention include a proximity-delay mode in which a trigger output from the proximity sensor actuates delayed detonation of the explosive charge. Such a mode could also be useful, for example, if munition 10 is to be guided into a building through an open window or over a low wall behind which a target has taken cover.

Figure 3C:
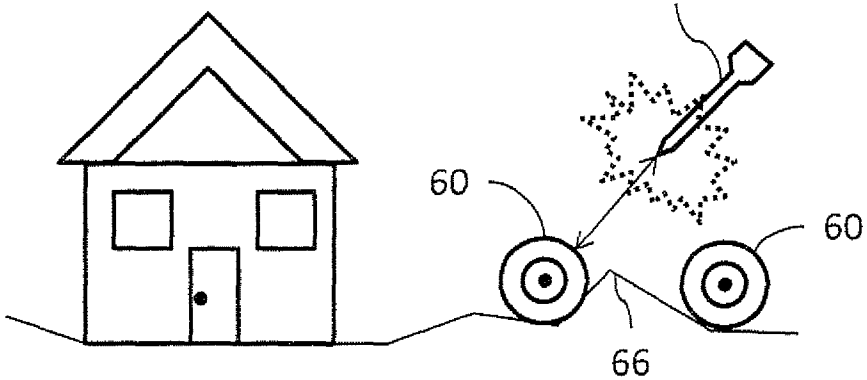

FIG. 3C illustrates a case where two targets 60 are seen by the operator via the real-time video display. Particularly in a case where some raised object, such as a ridge of ground 66 or a wall, separates between targets 60, use of an impact-triggered mode would probably be ineffective against the target sheltered by the raised object. To address this situation, the remote operator switches the fuze during flight to a proximity fuze state, in this case illustrated as a forward-proximity triggered state, causing fuze 18 to detonate explosive charge 16 at a defined height above the target or the ground. This provides an "air-burst" effect, with increased probability of being effective against both targets 60.

Figure 4A:
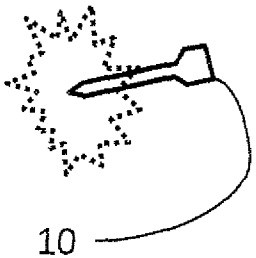
FIGS. 4A and 4B are schematic representations of operation of the switchable-mode guided munition of FIG. 1 in two further modes of operation.
Figure 4A:
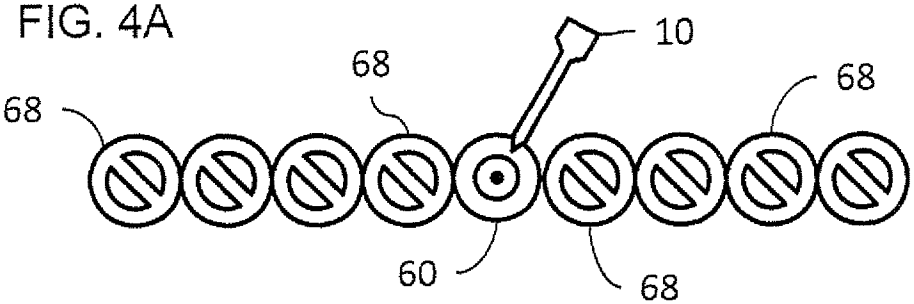

FIG. 4A illustrates schematically a target 60 located amongst a number of non-targets 68. In this case, any detonation of explosive charge 16 would lead to extensive collateral damage to the non-targets. Whereas prior to the present invention, important operations might typically be aborted under such circumstances, according to the present invention, the remote operator switches fuze arrangement 18 to neutralize the detonation system, thereby effectively converting munition 10 to a steerable kinetic shell. This renders it possible to continue to attach target 60, causing damage by kinetic impact, while minimizing or eliminating collateral damage.

Figure 4B:
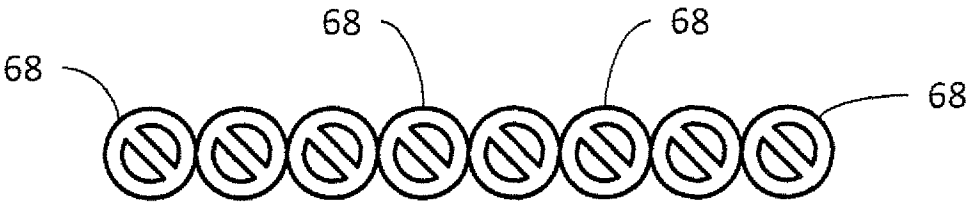

Finally, referring to FIG. 4B, this illustrates a case where, during flight, the remote operator observes in the real-time video from imaging sensor 14 that no target can be located, and the munition is in danger of impinging on various non-targets 68. For such cases, the remote operator may select either the aforementioned neutralized state (if it is possible to navigate munition 10 away from a direct hit on a non-target 68) or may directly trigger immediate detonation of explosive charge 16 so as to destroy munition 10 prior to reaching the targeted area.

It will be appreciated that the above descriptions are intended only to serve as examples, and that many other embodiments are possible within the scope of the present invention as defined in the appended claims.

What is claimed is:

1. A method for operating a guided munition carrying an imaging sensor, an explosive charge and a switchable fuze arrangement against a target, the method comprising the steps of:

(a) launching the guided munition towards the target;

(b) during flight of the guided munition, providing images from the imaging sensor to a remote operator;

(c) receiving from the remote operator a switching input; and (d) responsive to said switching input, switching the fuze arrangement to a selected one of a set of available states, said set of available states including at least two states selected from the group consisting of:

(i) a delayed detonation state in which detonation of the explosive charge is delayed by a time delay after impact of the guided munition, (ii) an impact detonation state in which detonation of the explosive charge occurs on impact of the guided munition, (iii) a proximity detonation state in which detonation of the explosive charge is triggered by a proximity sensing arrangement, and (iv) a disabled state in which the guided munition functions as a guided kinetic shell without detonation of the explosive charge.

2. The method of claim 1, wherein said set of available states includes at least three states selected from said group.

3. The method of claim 1, wherein said set of available states includes all of the four states of said group.

4. The method of claim 1, wherein said set of available states includes said delayed detonation state.

5. The method of claim 1, wherein said set of available states includes said impact detonation state.

6. The method of claim 1, wherein said set of available states includes said proximity detonation state.

7. The method of claim 6, wherein said proximity sensing arrangement is sensitive to proximity of an object located ahead of said guided munition.

8. The method of claim 6, wherein said proximity sensing arrangement is sensitive to proximity of an object located laterally with respect to said guided munition.

9. The method of claim 1, wherein said set of available states includes said disabled state.

10. The method of claim 1, wherein said fuze arrangement is additionally switchable to immediately detonate the explosive charge such that the guided munition self destructs.

11. The method of claim 1, wherein the guided munition is a guided surface-to-surface missile.

12. The method of claim 1, wherein the guided munition is a guided air-to-surface missile.

13. The method of claim 1, wherein the guided munition is a guided air-to-surface bomb.

14. A switchable-mode guided munition comprising:

(a) a munition body;

(b) an imaging sensor associated with said munition body for generating images of a target;

(c) an explosive charge housed within said munition body;

(d) a fuze arrangement associated with said explosive charge; and (e) a communication system for transmitting said images to a remote operator and for receiving inputs from the remote operator, wherein said fuze arrangement is configured as an in-flight-switchable fuze arrangement responsive to a switching input received from the remote operator via said communication system to switch to a selected one of a set of available states, said set of available states including at least two states selected from the group consisting of:

(i) a delayed detonation state in which detonation of the explosive charge is delayed by a time delay after impact of the guided munition, (ii) an impact detonation state in which detonation of the explosive charge occurs on impact of the guided munition, (iii) a proximity detonation state in which detonation of the explosive charge is triggered by a proximity sensing arrangement, and (iv) a disabled state in which the guided munition functions as a guided kinetic shell without detonation of the explosive charge.

15. The switchable-mode guided munition of claim 14, wherein said set of available states includes at least three states selected from said group.

16. The switchable-mode guided munition of claim 14, wherein said set of available states includes all of the four states of said group.

17. The switchable-mode guided munition of claim 14, wherein said set of available states includes said delayed detonation state.

18. The switchable-mode guided munition of claim 14, wherein said set of available states includes said impact detonation state.

19. The switchable-mode guided munition of claim 14, wherein said set of available states includes said proximity detonation state.

20. The switchable-mode guided munition of claim 19, wherein said proximity sensing arrangement is sensitive to proximity of an object located ahead of said guided munition.

21. The switchable-mode guided munition of claim 19, wherein said proximity sensing arrangement is sensitive to proximity of an object located laterally with respect to said guided munition.

22. The switchable-mode guided munition of claim 14, wherein said set of available states includes said disabled state.

23. The switchable-mode guided munition of claim 14, wherein said fuze arrangement is additionally switchable to immediately detonate the explosive charge such that the guided munition self destructs.

24. The switchable-mode guided munition of claim 14, wherein the guided munition is a guided surface-to-surface missile.

25. The switchable-mode guided munition of claim 14, wherein the guided munition is a guided air-to-surface missile.

26. The switchable-mode guided munition of claim 14, wherein the guided munition is a guided air-to-surface bomb.

* * * * *